US006742203B2

(12) United States Patent
Reynolds

(10) Patent No.: US 6,742,203 B2
(45) Date of Patent: Jun. 1, 2004

(54) MAT

(75) Inventor: Christopher John Reynolds, Buderim (AU)

(73) Assignee: C Gear Australia Pty Ltd., Moorabbin (AU)

( * ) Notice: Subject to any disclaimer, the term of this patent is extended or adjusted under 35 U.S.C. 154(b) by 0 days.

(21) Appl. No.: 10/441,077

(22) Filed: May 20, 2003

(65) Prior Publication Data

US 2004/0016054 A1 Jan. 29, 2004

Related U.S. Application Data

(63) Continuation of application No. PCT/AU01/01489, filed on Nov. 19, 2001.

(30) Foreign Application Priority Data

Nov. 20, 2000 (AU) ..... 1559

(51) Int. Cl.[7] ..... A47G 9/06
(52) U.S. Cl. ..... 5/420; 5/417
(58) Field of Search ..... 5/420, 417; 383/4

(56) References Cited

U.S. PATENT DOCUMENTS 2,051,494 A * 8/1936 Mitchell et al. ..... 297/382
3,051,966 A * 9/1962 Ness ..... 297/452.43
3,063,753 A * 11/1962 Mitchell ..... 297/452.44
3,123,838 A * 3/1964 Wilson ..... 156/462
3,814,030 A * 6/1974 Morgan, III ..... 108/57.25
5,002,014 A * 3/1991 Albin ..... 119/28.5
5,018,230 A * 5/1991 Steberger ..... 5/420
5,288,150 A * 2/1994 Bearman ..... 383/38
5,291,625 A * 3/1994 Leslie ..... 5/420
D360,797 S * 8/1995 Evans ..... D6/608
5,870,785 A * 2/1999 Hoorens ..... 5/652.1
5,895,118 A * 4/1999 Hensley ..... 383/3
6,276,828 B1 * 8/2001 Otley et al. ..... 383/4
2004/0016054 A1 * 1/2004 Reynolds ..... 5/420

* cited by examiner

*Primary Examiner*—Robert G. Santos
(74) *Attorney, Agent, or Firm*—Oliff & Berridge, PLC

(57) ABSTRACT

A mat for use on sand has a lower layer (2) and an upper layer (3). Sand is able to pass through both layers. Sand falling on the upper layer (3) can pass through it and either remain trapped between the two layers or pass through the lower layer (2) to the ground. The perimeters of each layer are preferably sewn together with overlapping tape (4). Suitable materials for the upper layer and lower layer include polypropylene mesh material, particularly shade cloth with a shade rating of approximately 70%. The mat may optionally include a sand-permeable third layer positioned over the upper layer. The third layer may be made from polyvinylchloride-coated nylon mesh material, and may be screen printed.

14 Claims, 2 Drawing Sheets

MAT

Figure 1:
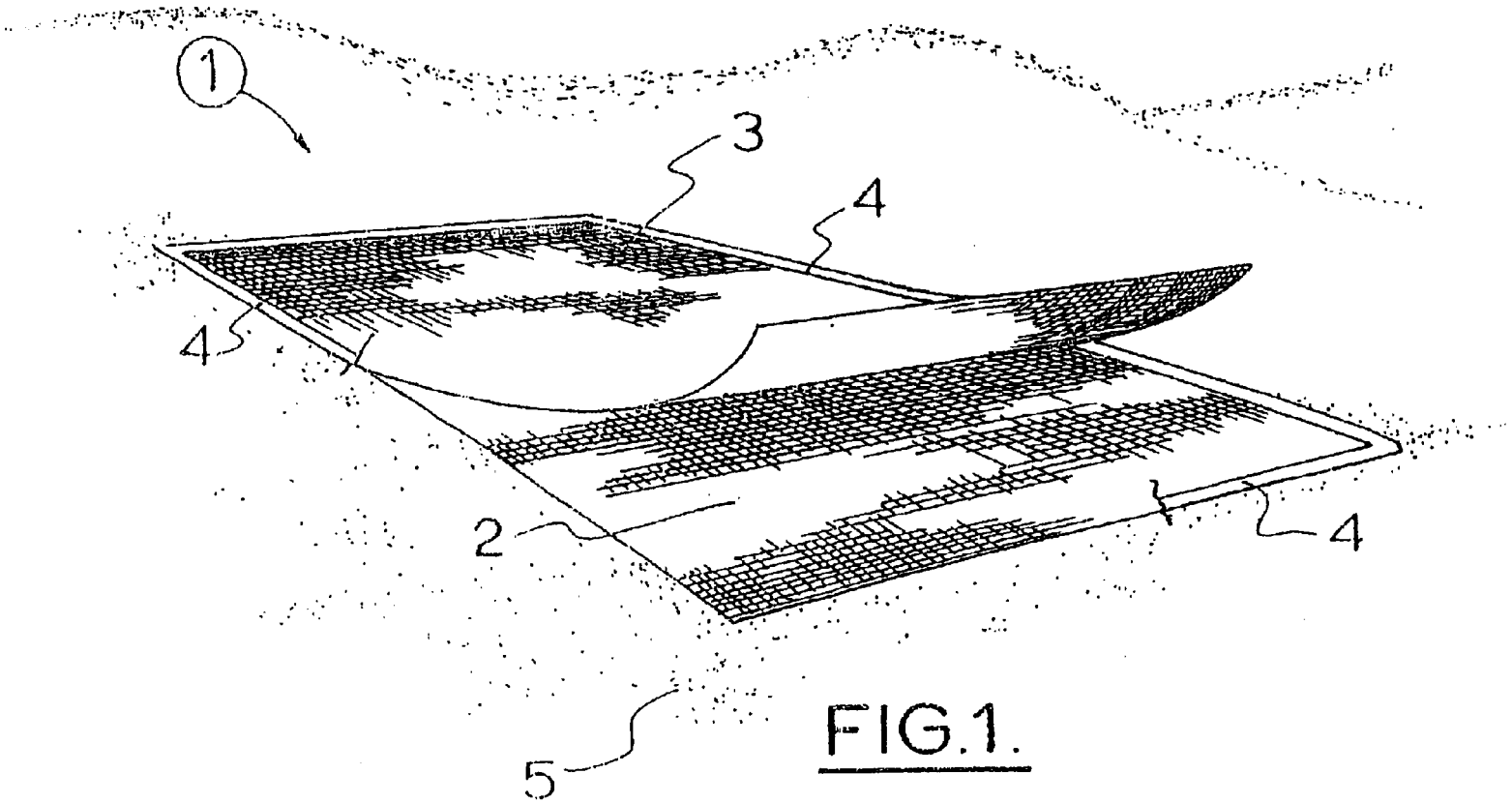

This application is a continuation of prior pending Internation Application No. PCT/AU01/01489, filed Nov. 19, 2001.

This invention relates to matting. In particular, although in no way limiting, it is directed to a mat for placing on sand and similar particulate material.

Attending the beach for swimming, sun bathing and similar pastimes is a popular recreational activity, especially in the warmer climates. Participants often have a need to sit, lie or otherwise recline on the sand. Usually, a towel is first placed on the ground to shield the person from the sand. However, any sand that was clinging to the person's skin, especially if the skin is wet, subsequently dries and falls from the person to remain on the upper surface of the towel thus making the towel uncomfortable to sit or lie on. Similarly, in windy conditions, sand is blown onto the towel. Periodically lifting the towel to try and remove this sand by shaking is not necessarily totally satisfactory as the towel is often wet-or at least damp and the sand remains clinging to the towelling fibres. Consequently, subsequent reuse of the towel to dry that person is, at best, uncomfortable as the sand remaining on the towel is also rubbed over the skin while attempting to soak up the water thereon.

A partial solution to this disadvantage of the traditional towel is to first place an undercloth on the sand and the towel is then placed on this undercloth. A popular undercloth in recent times has been one formed from lateral strips of bamboo or similar cane-like material sewn together in a mat-like configuration. While the relatively broad strips do contribute to preventing sand from passing upwards through it, the nature of its strip-like configuration leaves significant spacing between the strips which still allow a quantity of sand to pass therethrough and subsequently cling to the undersurface of any towel placed thereon.

Another attempt to at least partially resolve these disadvantages is disclosed in U.S. Pat. No. 5,018,230 wherein is described a mat of two layers, the upper layer being made of an open weave material through which sand may pass, the lower layer being made from a tight weave material to retain any sand that passes through the upper layer. However, this tight weave lower layer is manufactured from a terrycloth cotton and thus still suffers from the disadvantage of having the sand adhering to the underside of the lower layer.

It is therefore a general object of the present invention to overcome, or at least ameliorate, one or more of the above-mentioned disadvantages.

According to the present invention, there is provided a mat for use to place on particulate matter, said mat including:

a first layer having an upper surface and a lower surface, said first layer adapted to allow passage of said particulate matter therethrough when said lower surface is in contact with said particulate matter; and at least a second layer having an upper surface and a lower surface, said second layer adapted to allow passage of any of said particulate matter that may fall on said upper surface of said second layer to pass therethrough;

wherein said second layer is positioned substantially over said first layer to retain therebetween any of said particulate matter that has passed through said upper surface of said second layer and/or said lower surface of said first layer.

In a first embodiment of said mat, there is a single said second layer.

In a second embodiment of said mat, there is included a third layer positioned substantially over said second layer having an upper surface and a lower surface, said third layer also adapted to allow passage of any of said particulate matter that may fall on said upper surface of said third layer to pass therethrough.

Preferably, each of said first, said second and said third layer is of a mesh-like configuration.

Preferably, each of said first, said second and said third layer is manufactured from a flexible material.

Preferably, said flexible material is a plastic material.

Preferably, each of said first and said second layer is manufactured from polypropylene.

Preferably, said third layer is adapted to accept screen printing on its said upper surface.

Preferably, said third layer is manufactured from nylon.

More preferably, said third layer is manufactured from polyvinylchloride-coated nylon.

Preferably, said first layer is secured to said second layer and to any said third layer at the perimeter of each of said layer.

Figure 2:
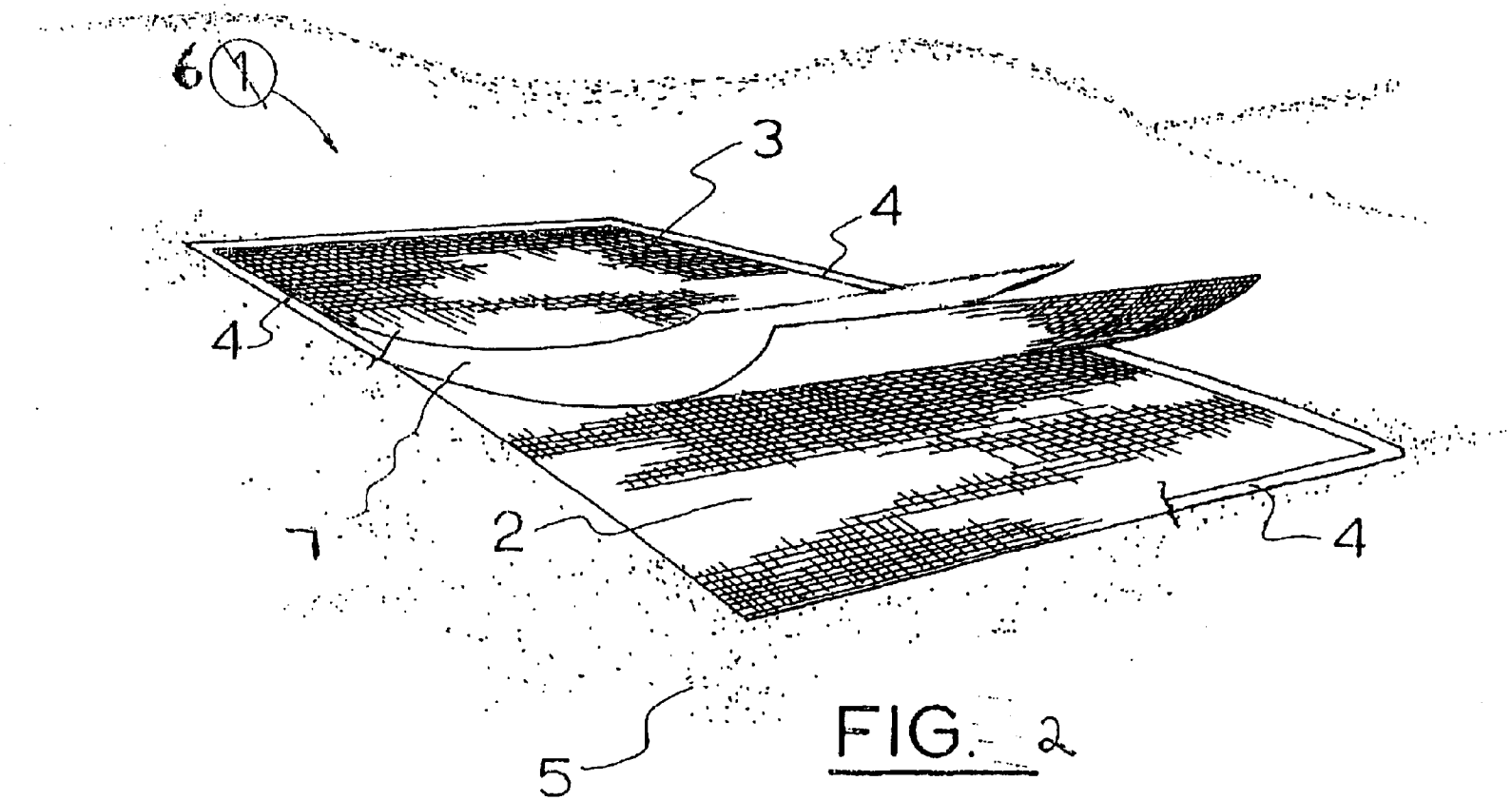

Preferred embodiments of the present invention will now be described with reference to the accompanying drawings wherein:

FIG. 1 is a schematic partially exploded representation of a first embodiment of a mat to be used at a beach; and FIG. 2 is a schematic partially exploded representation of a second embodiment of a mat to be used at a beach.

With reference to FIG. 1, the mat (1) comprises a first layer (2) secured to a second layer (3). Each layer (2,3) is manufactured from a flexible polypropylene mesh material. A suitable flexible mesh material is that marketed as shade cloth by a number of manufacturers with a shade rating of approximately 70%. The perimeters of each layer (2,3) are secured together with overlapping tape (4) which is sewn into position.

In use, when the mat (1) is placed on the sand (5) with the first layer (2) downwards, any sand that passes upwards through the lower surface of the first layer (2) is retained between the first layer (2) and the second layer (3). Similarly, any sand that falls on the upper surface of the second layer (3) and passes therethrough is also retained between the first layer (2) and second layer (3).

Although not wishing to be bound by theory, it is believed that the mesh-like structure of each layer (2,3) is such that there is substantially no overlap of the corresponding openings in each layer (2,3) when they are secured together thus allowing sand (5) to pass through each layer in a single direction only.

Turning now to the mat (6) illustrated in FIG. 2, the first layer (2) and the second layer (3) are exactly as described above with reference to FIG. 1. However, a third layer (7) manufactured from polyvinylchloride-coated nylon mesh material is positioned over the second layer (3) and the perimeters of each layer (2,3,6) are secured together with the overlapping tape (4). The upper surface of the third layer (7) can be screen-printed by any means known within the art to apply text, drawings, logos, slogans, etc (not illustrated) to its upper surface.

In use, when the mat (6) is placed on the sand (5) with the first layer (2) downwards, any sand that passes upwards through the lower surface of the first layer (2) is retained between the first layer (2) and the second layer (3). Any sand that falls on the upper surface of the third layer (7) passes through that layer and also through the second layer (3) to be retained between the first layer (2) and second layer (3).

It will be appreciated that the mats (1,6) can be of any convenient size and shape. Usually, when to be used as a beach mat, the shape will be rectangular and of a size sufficient to allow a beach towel or similar to be placed thereon. Of course, the size of the mat (1,6) could be extended to accommodate two or more of such towels. Similarly, even larger sizes could function as a ground cover for campers, keeping the tent free from sand or soil.

The present invention thus provides a mat which is of especial, but not limiting, use at the beach which can function as an undercloth for a towel to prevent passage of any sand through the undercloth to the towel and whereby any sand falling on the upper layer of the mat falls through thus also remaining clear of the towel.

Those skilled in the art will appreciate that modifications and alterations can be made to the mat as hereinbefore described without departing from the inventive concept as defined in the following claims.

What is claimed is:

1. A mat for use to place on particulate matter, said mat including:

a first layer having an upper surface and a lower surface, said first layer configured to allow passage of said particulate matter therethrough when said lower surface is in contact with said particulate matter; and at least a second layer having an upper surface and a lower surface, said second layer configured to allow passage of any of said particulate matter that may fall on said upper surface of said second layer to pass therethrough; wherein said second layer is positioned substantially over said first layer to retain therebetween any of said particulate matter that has passed through said upper surface of said second layer and/or said lower surface of said first layer.

2. A mat as defined in claim 1, wherein there is a single said second layer.

3. A mat as defined in claim 1 which further includes a third layer positioned substantially over said second layer having an upper surface and a lower surface, said third layer adapted to allow passage of any of said particulate matter that may fall on said upper surface of said third layer to pass therethrough.

4. A mat as defined in claim 1, wherein each of the first and the second layer is of a mesh configuration.

5. A mat as defined in claim 2, wherein each of the first and the second layer is of a mesh configuration.

6. A mat as defined in claim 3, wherein the third layer is of a mesh configuration.

7. A mat as defined in claim 4, wherein the mesh configuration is provided by a flexible material.

8. A mat as defined in claim 7, wherein the flexible material is a plastic material.

9. A mat defined in claim 4, wherein each of the first and the second layer is manufactured from polypropylene.

10. A mat as defined in claim 6, wherein each of the first and the second layer is manufactured from polypropylene.

11. A mat as defined in claim 6, wherein the third layer is adapted to accept screen printing on its the upper surface.

12. A mat as defined in claim 11, therein the third layer is manufactured from nylon.

13. A mat as defined in claim 12, wherein the third layer is manufactured from polyvinylchloride-coated nylon.

14. A mat as defined in claim 1, wherein the first layer is secured to the second layer and to any other layer at the perimeter of each layer.

* * * * *